US011731437B2

(12) United States Patent
Van De Sande et al.

(10) Patent No.: US 11,731,437 B2
(45) Date of Patent: Aug. 22, 2023

(54) INKJET PRINTER WITH TRANSPORT BELT DEFORMATION COMPENSATION

(71) Applicant: Canon Production Printing Holding B.V., Venlo (NL)

(72) Inventors: Henricus J. A. Van De Sande, Venlo (NL); Sjirk H. Koekebakker, Venlo (NL); Mark Rietbergen, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 372 days.

(21) Appl. No.: 17/038,382

(22) Filed: Sep. 30, 2020

(65) Prior Publication Data

US 2021/0101391 A1 Apr. 8, 2021

(30) Foreign Application Priority Data

Oct. 8, 2019 (EP) ..... 19201943

(51) Int. Cl.
*B41J 11/00* (2006.01)
*B41J 13/08* (2006.01)
(Continued)

(52) U.S. Cl.
CPC ..... *B41J 11/007* (2013.01); *B41J 13/08* (2013.01); *B41J 29/46* (2013.01); *B65H 29/16* (2013.01);
(Continued)

(58) Field of Classification Search
CPC ..... B41J 11/007; B41J 13/08; B41J 29/46; B65H 29/16; B65H 43/08; B65H 2404/2532; B65H 2404/285
See application file for complete search history.

(56) References Cited

U.S. PATENT DOCUMENTS

2008/0044211 A1* 2/2008 Otomo ..... B41J 11/007 399/395
2009/0220873 A1* 9/2009 Enomoto ..... B41J 11/007 399/68
(Continued)

FOREIGN PATENT DOCUMENTS

EP 3 196 036 A1 7/2017
JP 2008225163 A * 9/2008 ..... G03G 15/01
JP 2010243205 A * 10/2010 ..... G01B 11/24

OTHER PUBLICATIONS

European Search Report, issued in Application No. 19 20 1943, dated Mar. 10, 2020.

*Primary Examiner* — Yaovi M Ameh
(74) *Attorney, Agent, or Firm* — Birch, Stewart, Kolasch & Birch, LLP

(57) ABSTRACT

An inkjet printer and a method for controlling an inkjet printer are disclosed. The inkjet printer is provided with an endless transport belt for transporting a medium to be printed; at least one roller for driving the transport belt and at least one additional roller for driving and/or suspending the transport belt; a detection system configured to detect a deformation of the transport belt including at least an in-plane bending deformation of at least a stretch of the transport belt and to generate at least one deformation signal indicating the detected deformation; an actuator assembly configured to change a position and/or orientation of at least one of the rollers of the inkjet printer; and a controller configured to control the actuator assembly based on the at least one deformation signal.

14 Claims, 5 Drawing Sheets

(51) Int. Cl.

| | |
|---|---|
| ***B41J 29/46*** | (2006.01) |
| ***B65H 29/16*** | (2006.01) |
| ***B65H 43/08*** | (2006.01) |

(52) U.S. Cl.
CPC ..... *B65H 43/08* (2013.01); *B65H 2404/2532* (2013.01); *B65H 2404/285* (2013.01)

(56) References Cited

U.S. PATENT DOCUMENTS

| | | | | |
|---|---|---|---|---|
| 2011/0063353 | A1* | 3/2011 | Takeuchi | B41J 2/16526 347/14 |
| 2011/0205324 | A1* | 8/2011 | Shukuya | G03G 15/043 347/116 |
| 2012/0148299 | A1* | 6/2012 | Yamamoto | G03G 15/1615 399/302 |

* cited by examiner

INKJET PRINTER WITH TRANSPORT BELT DEFORMATION COMPENSATION

FIELD OF THE INVENTION

The present invention generally pertains to an inkjet printer with transport belt deformation compensation and to a method for controlling (or: operating) such a printer.

BACKGROUND ART

Sheet printers are a common type of printers in which individual cut sheets of a medium such as paper are usually transported by an endless transport belt between a medium input, a print head, and a medium output of the printer. The endless transport belt (or: print belt) is usually suspended on, and driven by, a plurality of rollers. Sheets are often adhered to the belt either by electrostatics or by suction holes (or: perforations) through which an underpressure or negative pressure acts on sheets being transported. Thus, the cut sheets of the medium can normally be placed quite accurately and securely on the transport belt.

However, during the lifetime of a printer, or sometimes even during one operation of the printer, one or more of the rollers driving and/or suspending the transport belt may deviate from their nominal position and/or orientation, i.e. be subject to displacement. This in turn may cause the transport belt to suffer deformation, reorientation, and/or lateral displacement.

FIG. 6 schematically shows four cross-sections through different rollers A through D, each suffering from a different deviation from its nominal position and/or orientation. In roller A, a center line through the bearings 1, 2 and/or a shaft 3 does not coincide with a centerline of the cylindrical roller surface 4 of roller A. This results in an antisymmetric (out-of-phase) runout left and right.

Roller B has an asymmetric runout with a runout on the left but no runout on the right. Roller C suffers from radial runout present in the right bearing 2 which causes the roller surface 4 to move in a similar way as roller B.

In the situation of rollers A through C, the radial runout can also lead to a secondary, lateral (or: axial) displacement L of the rollers as indicated in FIG. 6.

At roller D, the right bearing 2 is shown with a slight axial runout leading to axial runout of the roller surface 4 of the roller D.

US 2009/0220873 A1 describes a belt skew controlling method in which a transport belt is provided with sensors for detecting a skewing of a transport belt and with a skew correcting roller of non-uniform cylindrical diameter for attempting to correct the detected skew.

EP 3 196 036 A1 describes a method for controlling a lateral position of an endless belt of a belt conveyor system in order to restore a nominal position of the transport belt.

However, in particular when the transport belt consists of a more deformable, or elastic, material such as a polymer, a large variety of possible deformations of the transport belt exists that may have to be dealt with in order to guarantee a desired printing quality. Even in more rigid transport belts formed of e.g. metal, similar deformation and displacement problems may occur.

SUMMARY OF THE INVENTION

It is therefore one of the objects of the present invention to provide an inkjet printer with improved position control of its endless transport belt, specifically with compensation of deformation of its endless transport belt.

This object is solved at least by the subject-matter of the independent claims. Advantageous embodiments, refinements and variants of embodiments are presented in the depending claims.

Accordingly, the present invention provides an inkjet printer comprising:

an endless transport belt for transporting a medium to be printed;

at least one roller for driving the transport belt and at least one additional roller for driving and/or suspending the transport belt;

a detection system configured to detect a deformation of the transport belt including at least an in-plane deformation of at least a stretch of the transport belt and to generate at least one deformation signal indicating the detected deformation;

an actuator assembly configured to change a position and/or orientation of at least one of the rollers of the inkjet printer; and a controller configured to control the actuator assembly based on the at least one deformation signal.

An in-plane bending deformation (even more precisely: in-plane lateral bending deformation) shall be understood to be a type of deformation of a stretch of the transport belt within a plane, in which one lateral edge of the transport belt acquires a concave curvature and the other, opposite lateral edge of the transport belt acquires a convex curvature. Moreover, "including at least an in-plane bending deformation" should be understood to mean that the detection system is configured to detect at least this type of deformation but that the detection system may moreover be configured to detect also additional types of deformation such as shearing deformations in which the lateral edges stay parallel to one another but are no longer in parallel to the nominal travel direction (or: longitudinal direction) of the transport belt.

The deformations described herein may be static or, more commonly, dynamic, as a given displacement of even one end of a rotating roller will often cause a cyclical deformation of the transport belt.

The actuator assembly is preferably controlled by the controller to sufficiently (or even completely) compensate the detected deformation.

In the present context, "sufficiently compensate" shall be understood to mean that the deformation is, after a sufficient compensation, (at least) below a predefined threshold. This threshold may be fixed for a certain inkjet printer or it may be provided as a part of each individual print job. For example, a first client may insist that the orientation of a printed image on a medium is accurate to within 1 mrad, whereas a second client may be content if the orientation is accurate within 1°. However, since in general it is desired that each print job is as good as possible, "sufficiently compensate" can also be understood to mean "at least sufficiently compensate", i.e. compensate such that the deformation is below a predefined threshold, but moreover compensate the deformation as much as possible.

Expressed differently, the actuator assembly is preferably controlled to change a position and/or orientation of at least one of the rollers of the inkjet printer such as to bring the trajectory (or 3-dimensional form) of the endless transport belt more closely (or even completely) into registration with its nominal trajectory (or nominal 3-dimensional form). In some variants, a combination of mechanical compensation by the actuator assembly with software compensation mechanisms may be employed.

For example, it may be determined by the controller whether the detected deformation can be completely compensated using the actuator assembly or not. If that is the case, then the actuator assembly is controlled accordingly. If that is not the case, then it may be determined whether the actuator assembly is able to influence the trajectory of the transport belt in such a way that a deformation of such a kind remains that can be compensated via software adjustments, for example by distorting and/or shifting a print job to be printed to counteract the remaining deformation. Only in case of deformations that cannot be compensated by any of these two options may then the operation of the inkjet printer be suspended, or aborted, until mechanical causes of the deformation can be fixed at least to such a degree that the above-described compensation mechanisms are again sufficient.

The transport belt may comprise, or consist of, a foil or sheet, the opposite ends of which have been connected to form an endless belt. The foil is preferably formed of an elastic material, such as plastic, though different materials such as metals may be applied. The foil is preferably perforated to provide a plurality of through-holes for applying the underpressure. Said perforations are preferably sufficiently small to reduce air leaking around the edges of the media into the suction chamber below the transport belt. The perforations are further sufficiently large and/or sufficiently densely provided to provide secure holding down of the media. Alternatively, the foil may be formed of an air permeable material, foregoing the step of perforating the foil to achieve air permeability.

However, the present invention is most efficacious when applied to a transport belt consisting of at least one type of polymer, or plastics, as such transport belts tend to suffer more acutely from deformation than, for example, metal transport belts. In particular, in-plane bending deformation is a lot more common with said types of transport belts than with metal transport belts.

The present invention thus allows to use cheaper and lighter polymeric (or: plastic) transport belts instead of metallic (or otherwise reinforced) transport belts, and to compensate for their comparatively higher propensity for in-plane bending such that nevertheless a sufficient level of quality of the print jobs can be guaranteed.

In some advantageous embodiments, variants, or refinements of embodiments, the transport belt comprises a plurality of markings (e.g. in the form of a row of holes in the belt), and the detection system is configured to detect the markings and to generate the deformation signal based on detected and/or undetected markings. Said markings may be optically, in particular visually, detectable signs or symbols and/or physical modifications of the structure of the transport belt such as perforations, bumps, ridges and/or the like. For improved accuracy, the detection system is configured to determine a position of each marking with respect to a fixed frame of the printer. Even greater accuracy may be achieved by the detection system determining the position of a reference point (e.g. the center of mass or area) of each marking with respect to the fixed frame. Additionally, the detection system may be configured to accurately determine the time at which the position of each marking was detected. The position determination may be applied to determine deformation, orientation, and/or displacement of the transport belt, while the time determination may further be applied for determining dynamic properties, such as the velocity, of the transport belt.

In some advantageous embodiments, variants, or refinements of embodiments, the detection system comprises at least three optical detectors. In this way, the curvature of an edge of the transport belt can be efficiently detected. An optical detector may be any detector that detects electromagnetic radiation, for example a visible-light camera, an infrared camera, a UV camera and/or the like. The detector may in each case comprise a corresponding electromagnetic radiation source, such as a light source, which may, for example, shine electromagnetic rays through perforations in the transport belt which are then detected in order to determine the position of the perforation. Advantageously, many inkjet printers already employ one or more optical detectors for measuring the current travel speed of the transport belt, e.g. in order to regulate the travel speed to a nominal travel speed. Thus, already existing optical detector (s) can be incorporated into the hardware used for the present invention, saving costs.

Preferably, each optical detector is arranged and configured to detect the markings of (or in, or on) the transport belt at a different location and to generate a corresponding optical detector signal. Herein, "at a different location" should be understood to mean that at one and the same point in time, the three optical detectors detect markings at different locations of the belt. The detection system is configured to generate the deformation signal based on the at least three optical detector signals. The optical detectors are preferably spaced apart from one another along the transport direction. Each detector may be configured to determine the position of a reference point of each marking with respect to the respective location of each detector. The detector may receive the radiation or light coming from a marking and analyze this to determine the position of the marking with respect to the detector's location. For example, each detector determines the position of the center of mass (or another suitable reference point) of each marking. By comparing the positions determined by each detector an indication of the transport belt's deformation, orientation, and/or displacement may be determined. To improve accuracy this determination may take into account pre-stored or pre-determined information regarding the exact locations of the detectors and/or the relative positioning of the markings on the transport belt (e.g. total number of markings, their shapes, positional deviations, etc.).

In some advantageous embodiments, variants, or refinements of embodiments, the transport belt is provided with a plurality of equally-spaced perforations along its longitudinal extent, and each of the optical detectors is configured to detect the presence or absence of perforations. For example, as described in the foregoing, an electromagnetic radiation source (e.g. a light source) may be arranged to shine through at least one perforation into the detector when the perforation in the moving belt is currently aligned between the radiation source and the detector and be further arranged to be blocked by the belt when no perforation is currently aligned in this way. Thus, every time electromagnetic radiation is detected by the optical detector, it can be inferred that the transport belt has moved by the distance between two perforations. If the movement speed of the belt is known from another source (e.g. usually from the print controller), then a missing detection of the electromagnetic radiation indicates a deformation of the belt in a particular way. Preferably, the electromagnetic radiation is visible light.

In some advantageous embodiments, variants, or refinements of embodiments, at least two of the at least three optical detectors are arranged in a line parallel to a nominal (or: ideal, or: desired) lateral edge of the transport belt. For example, the optical detectors may be arranged directly over said lateral edge. Usually, the nominal lateral edge of the belt is a straight line so that deviations of the lateral edge of the belt from a straight line indicate an undesired deformation of the transport belt, in particular in-plane bending deformations. Preferably, at least three of the at least three optical detectors are arranged in the line parallel to the nominal lateral edge. In this way, an accurate detection of curvatures is achieved. In variant, at least two optical detectors may be placed for detecting one lateral edge of the transport belt, and at least one optical detector may be place between these two optical detectors but for detecting the other lateral edge of the transport belt.

In some advantageous embodiments, variants, or refinements of embodiments, the detection system comprises an image-capturing camera configured to acquire an image of a lateral edge of the transport belt and a computing module configured to extract the curvature of the lateral edge within the acquired image and to generate the deformation signal based on the extracted curvature. For instance, if a curvature of zero, i.e. a straight line, is extracted, that may signify no in-plane bending deformation, and a non-zero curvature may signify that there is in-plane bending deformation which causes the lateral edge of the transport belt to curve, i.e. to bend.

In some advantageous embodiments, variants, or refinements of embodiments, the actuator assembly comprises at least one axial actuator configured to change the axial positioning of a first end of a first roller of the rollers of the inkjet printer. This is one efficient way to reduce or eliminate a deformation of the transport belt.

In some advantageous embodiments, variants, or refinements of embodiments, the actuator assembly further comprises at least one longitudinal actuator configured to change the positioning of a first end of a first roller along a travel (or: transport) direction of the transport belt. This is another efficient way to reduce or eliminate a deformation of the transport belt. Herein, "longitudinal actuator" has been used as a designation because the travel direction of the transport belt is also a longitudinal direction of the transport belt.

Although variants are possible which only comprise an axial actuator or only a longitudinal actuator, it is preferred that at least one roller, a plurality of rollers, or even all of the rollers, is/are provided with both an axial actuator and a longitudinal actuator, advantageously on the same end of said roller. In some advantageous refinements, at least one roller, a plurality of rollers or even all of the rollers are provided with both an axial actuator and a longitudinal actuator at a first, and are furthermore provided with an axial actuator and/or a longitudinal actuator also on their other, second end. An increasing number of actuators increases the ability of the inkjet printer to compensate a large variety of deformations but also increases the costs and the space necessary in the inkjet printer. Herein, the first and the second end of each roller shall be understood as a first and a second axial end (with respect to the roller) or as a first and a second lateral end if designated with respect to the transport belt, since the rollers extend with their axes in the transverse direction of the transport belt.

In all of these cases, in addition to the axial actuator and the longitudinal actuator, also a third actuator for movements orthogonal to the axial direction as well as to the nominal belt travel direction (at the stretch of the transport belt) may be provided so that an end of a roller may be displaced in all three spatial dimensions.

In some advantageous embodiments, variants, or refinements of embodiments, the inkjet printer further comprises a print controller configured to change at least one parameter of a print job to be printed based on the deformation signal. As has been described in the foregoing, this may in particular be used to compensate for any remaining deformation of the transport belt which could not be (or was not, for other reasons) compensated by the actuator assembly.

In some advantageous embodiments, variants, or refinements of embodiments, the transport belt consists of at least one type of plastic, or polymer. Such transport belts are comparatively cheap and light but are usually more strongly subject to deformation; thus, the invention described herein is very well suited to the challenges of such plastic transport belts.

The present invention also provides a method for controlling (or: operating) an inkjet printer, comprising the steps of:

driving an endless transport belt of the inkjet printer for transporting a medium to be printed using at least one roller, wherein in addition at least one additional roller for driving and/or suspending the transport belt is provided;

detecting a deformation of the transport belt including at least an in-plane bending deformation of at least a stretch of the transport belt;

generating at least one deformation signal indicating the detected deformation; and controlling an actuator assembly to change a position and/or orientation of at least one of the rollers of the inkjet printer based on the at least one deformation signal.

In some advantageous embodiments, variants, or refinements of embodiments, the method further comprises the steps of: determining whether the actuator assembly can be controlled such as to sufficiently compensate for the detected deformation; and controlling, if that is the case, the actuator assembly to sufficiently compensate the detected deformation. In case that the deformation cannot be sufficiently compensated, i.e. compensated to a previously specified degree, operation of the inkjet printer may be stopped. However, as will be described in the following, other options are also available in such a case.

In some advantageous embodiments, variants, or refinements of embodiments, the method further comprises the steps of: determining, when it is determined that the actuator assembly cannot be controlled such as to sufficiently compensate for the detected deformation, whether or not the actuator assembly is able to compensate the detected deformation such as to leave a remaining deformation, wherein the remaining deformation is such that it can be sufficiently compensated by adjusting a print job; and, when that is the case:

controlling the actuator assembly to compensate the detected deformation such that the determined remaining deformation remains; and adjusting the print job such as to sufficiently compensate the remaining deformation.

Not only can in this way a larger number of deformations be compensated, it is also possible to reduce the total numbers of actuators of the actuator assembly necessary for—together with the software-based compensation—completely compensating all, or at least the most likely and/or the most disruptive (to printing), deformations. This is because not a priori all possible deformations have to be dealt with by the actuator assembly alone but the actuator assembly can be designed advantageously such that it compensates only deformations of the transport belt not compensable by software alone and/or such that it compensates deformations of the transport belt in such a way that only deformations compensable by software alone remain.

In some advantageous embodiments, variants, or refinements of embodiments, the method further comprises the step of outputting, when it is determined that the actuator assembly cannot be controlled such as to leave a remaining deformation that can be sufficiently compensated by adjusting a print job, a warning signal. For example the warning signal may be configured to cause the current print job to be aborted. The warning signal may alternatively simply cause a visual or acoustic warning to be output to a supervisor of the inkjet printer and/or the like.

In further aspects, the present invention provides a computer program product comprising executable program code configured to, when executed, perform the method according to the present invention as well as a non-transitory, computer-readable data storage medium (such as a DVD, a CD-ROM, a memory stick, a solid state drive and so on) comprising executable program code configured to, when executed, perform the method according to the present invention.

It should be understood that the controller of the inkjet printer according to embodiments of the invention may be configured in particular to perform any embodiment of the method of the present invention.

BRIEF DESCRIPTION OF THE DRAWINGS

The present invention will become more fully understood from the detailed description given hereinbelow and the accompanying schematic drawings which are given by way of illustration only, and thus are not limitative of the present invention, and wherein.

DETAILED DESCRIPTION OF THE DRAWINGS

Figure 1:
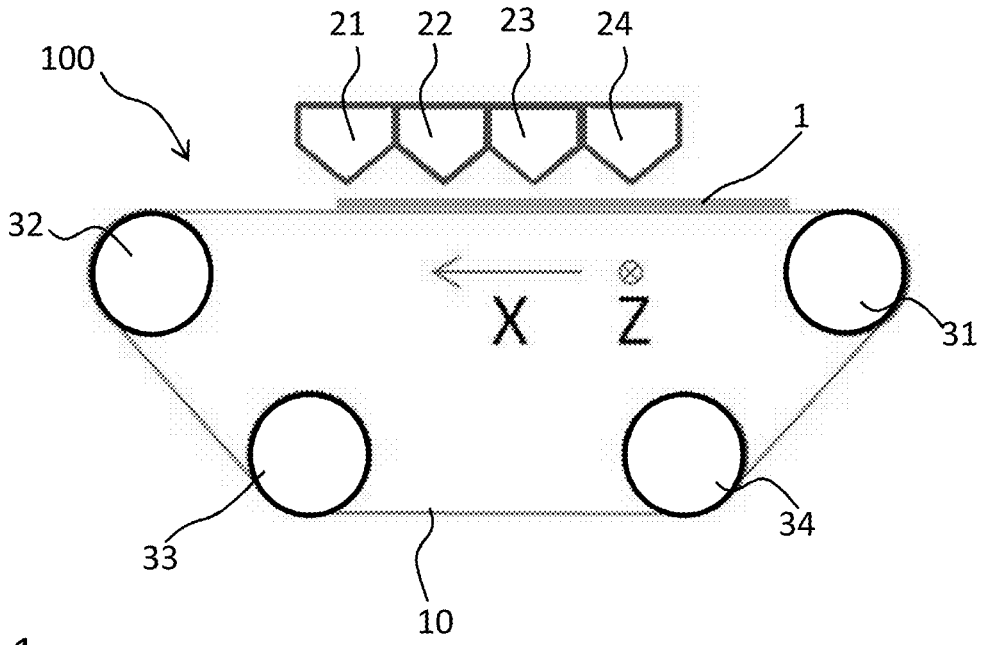
FIG. 1 schematically illustrates an inkjet printer according to an embodiment of the present invention.

The present invention will now be described with reference to the accompanying drawings, wherein the same reference numerals have been used to identify the same or similar elements throughout the several views, and in some instances throughout the several embodiments. The numbering of method steps is, if not explicitly or implicitly described otherwise, not intended to necessarily indicate a time ordering of steps. In particular, several steps may also be performed simultaneously.

FIG. 1 schematically illustrates an inkjet printer 100 according to an embodiment of the present invention, which will be described further and in more detail with respect to FIG. 2 and FIG. 3.

The inkjet printer 100 comprises an endless transport belt 10 in form of a loop and four print heads 21, 22, 23, 24 arranged for printing (by ejecting ink) onto a sheet of a medium 1 such as paper transported by the transport belt 10. The inkjet printer 100 further comprises a plurality of rollers 31, 32, 33, 34, wherein at least one roller 32 is configured to for driving the transport belt 10, i.e. to cause its movement along its longitudinal extent, in FIG. 1 schematically shown as arranged in x-direction, whereas the ink would be ejected from the print heads 21, 22, 23, 24 in y-direction. The rollers 31, 32, 33, 34 are essentially cylindrical in form and are arranged with their axes in z-direction, wherein x, y, and z form an orthogonal coordinate system. Rollers 31-34 may be arranged and configured for driving and/or suspending the transport belt 10.

Figure 2:
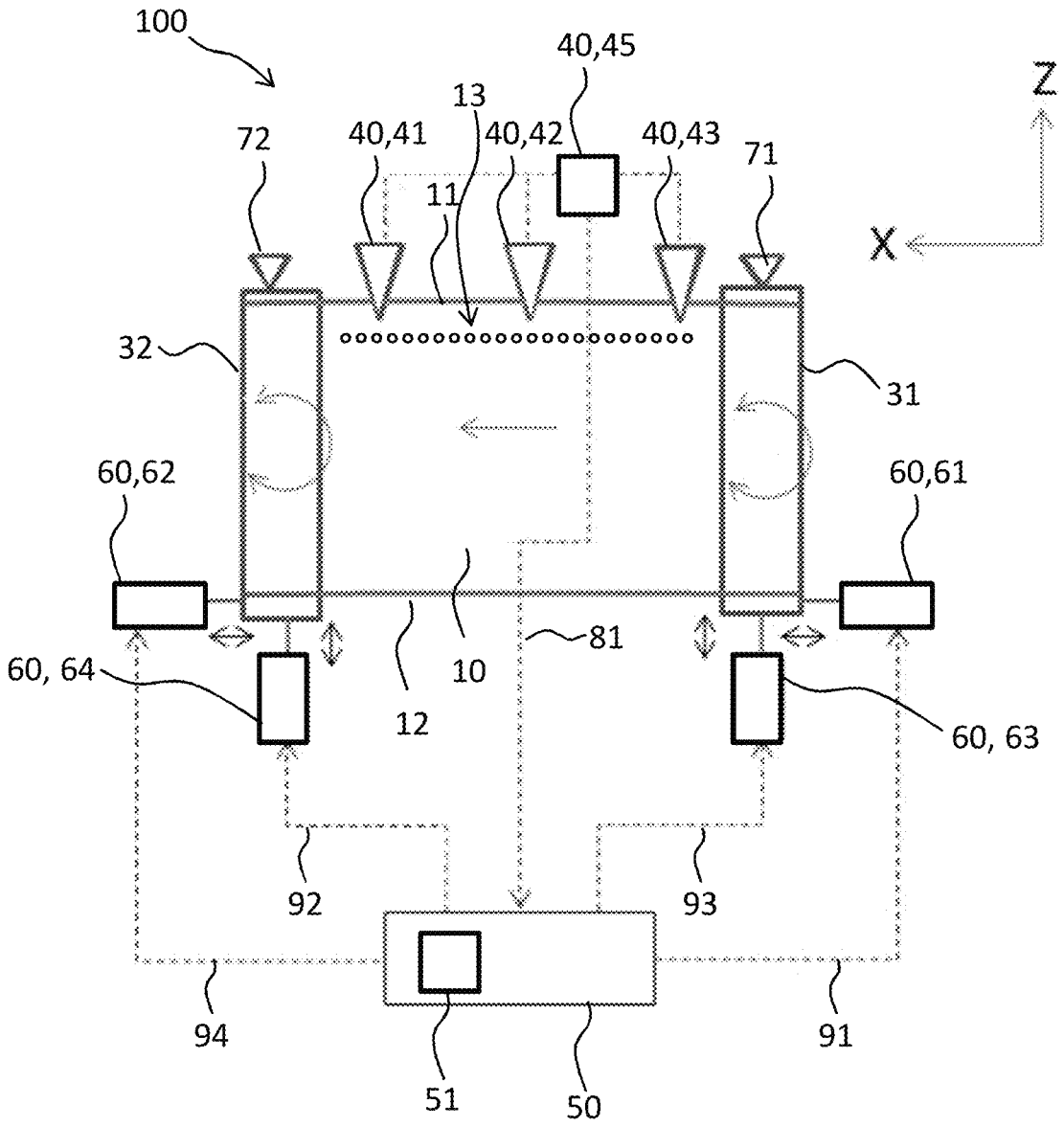
FIG. 2 and FIG. 3 schematically illustrate further details of the inkjet printer of FIG. 1.

In FIG. 2, a schematic top view of the transport belt 10 in its nominal position is shown. Along a first lateral edge 11 of the transport belt 10 which is arranged along the x-direction, i.e. along the travel direction of the transport belt 10, three optical detectors 41, 42, 43 are arranged which form part of a detection system 40. As has been described in the foregoing, more or less than three sensors may be provided, the sensors may be provided at different lateral edges 11, 12 of the transport belt, may use other detection techniques than optical techniques and/or the like.

The detection system 40 is configured to detect a deformation of the transport belt 10 including at least an in-plane bending deformation of at least a stretch of the transport belt 10 and to generate at least one deformation signal 81 indicating the detected deformation. In case that the deformation of only a stretch is measured, it is preferred that the stretch is a stretch in which the print heads 21, 22, 23, 24 and/or other processing units of the inkjet printer 100 such as curing units, drying units and/or the like are arranged. In other words, the stretch is preferably a stretch with units whose precise function depends on precise positioning with respect to the transported medium 1 and thus on precise positioning and shape (or at least precise knowledge of the positioning and/or shape) of the transport belt 10.

Each of the optical detectors 41, 42, 43 may generate its own output signal, and a deformation calculation module 45 of the detection system 40 of the inkjet printer 100 may be configured to generate the deformation signal 81 indicating a deformation of the transport belt 10 thereon.

In the present example shown in FIG. 2, the optical detectors 41, 42, 43 are configured to detect the presence or absence of markings 13, in particular perforations, on or in the transport belt 10, wherein the markings 13 are arranged in a line parallel to the first lateral edge 11 of the transport belt at a substantially fixed distance from one another and at a fixed distance d1 from the lateral edge 11. Each detector 41, 42, 43 is configured to accurately determine the position x of each marking 13 with respect to said detector's location, as the marking 13 passes by said detector 41, 42, 43. In one particular example, each detector 41, 42, 43 detects an image representing the passing marking 13 and determines the position x of said marking 13 by analyzing said image, for example by determining the position x of the middle or center of mass of the marking 13 in said image. This detected position x may be combined with the location of the respective detector 41, 42, 43 to determine the position x of the detected marking 13 with respect to a fixed frame of the printer. By comparing the detected positions of markings 13 (or of the same marking 13 each passing) deviations in the velocity and position of the transport belt 10 can be determined. In the ideal case where the markings are identical in shape and spacing, the detected positions x for all markings 13 should be the same when the transport belt 10 is in the nominal position and moves with a constant travel speed v. The deformation calculating module 45 compares the detected positions x of the markings 13 to determine the position and/or deformation of the transport belt 10. For example, if the deformation calculating module 45 determines a similar shift in the positions x of one or more markings at all three detectors 41, 42, 43, this may be indicative of a lateral displacement of the transport belt 10. When the positional shifts differ at each detector 41, 42, 43, but vary in a linearly increasing manner with respect to the transport direction, the deformation calculating module 45 may determine that a rotation of the transport belt 10 has taken place. Bending may be determined from a non-linear relation between the determined positional shifts at each detector 41, 42, 43, for example when the positional shift at the outer detectors 41, 43 exceeds and/or is of opposite sign than the positional shift determined at the middle detector 42.

Also shown in FIG. 2 is a plurality of actuators 61, 62, 63, 64 which together form (or form part of) an actuator assembly 60 of the inkjet printer 100. The actuators 61, 62, 63, 64 are controllable by a controller 50, in particular by an actuator control module 51 of the controller 50. The actuator control module 51 is configured to provide control signals 91-94 to the actuators 61, 62, 63, 64 for compensating, completely or partially, a deformation of the transport belt 10 as indicated by the at least one deformation signal 81 provided by the detection system 40 and/or by the deformation calculating module 45.

The controller 50 may be integrated into a printer controller of the printer 100 or may be realized as separate from it. The controller 50 may be completely or partially realized as software (including one or more modules) run by a computing device. Although for ease of understanding the controller 50 and the deformation calculating module 45 of the detection system 40 have been described separately, it should be understood that both may be realized, or implemented, by one and the same computing device running different sections of program code.

In this example, for each of the rollers 31, 32, a longitudinal actuator 61, 62 and an axial actuator 63, 64 is provided, all of them at an end of the respective roller 31, 32 adjacent to a second lateral edge 12 of the transport belt 10 which is opposite the first lateral edge 11 of the transport belt 10 at which the optical detectors 41, 42, 43 are arranged. Other arrangements may be possible as well, depending on the overall geometry of the inkjet printer 100.

In this way, a respective first end of both rollers 31, 32 is held fixed in place by a respective bearing 71, 72 at the first lateral edge 11, and a respective second end of both rollers 31, 32 is movable in x-direction by the longitudinal actuators 61, 62 and in z-direction by the axial actuators 63, 64. As has been described in the foregoing, additional vertical actuators of the actuator assembly 60 may be arranged with which the respective second ends of the rollers 31, 32 could also be moved in y-direction. In variant embodiments, only one roller 31, 32 may be provided with all two, or all three, types of actuators (longitudinal, axial, vertical), or one or more rollers 31, 32 may be provided with all two, or all three, types of actuators at both ends and/or the like. The actuators 61, 62, 63, 64 shown in FIG. 2 are especially suitable for compensating an in-plane bending deformation of the transport belt 10 as illustrated in the following with respect to FIG. 3.

Figure 3:
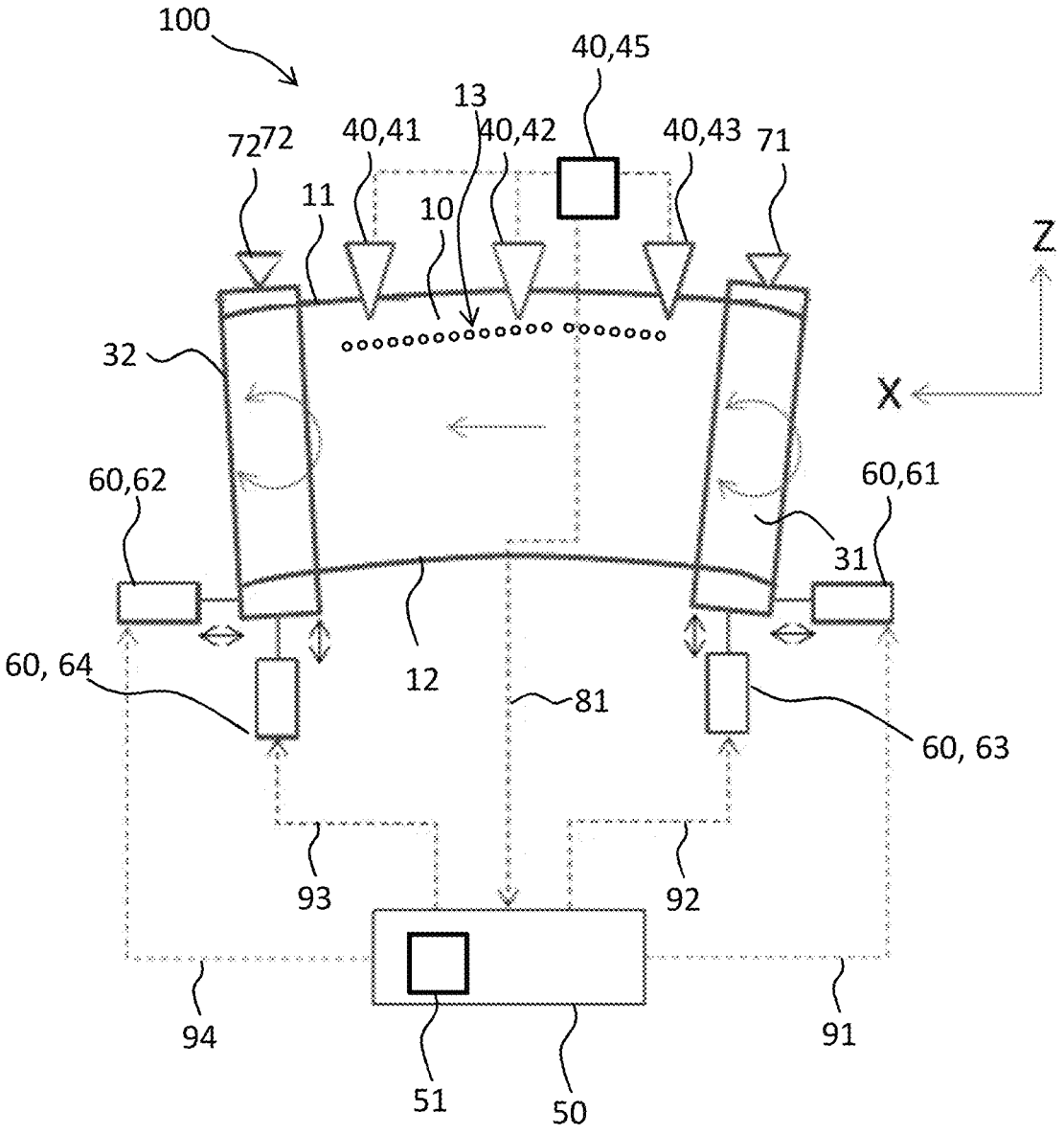

In FIG. 3, the same elements from the same viewpoint as in FIG. 2 are shown, with the difference that now the transport belt 10 is no longer in the nominal position but has instead developed an in-plane bending deformation, for example because of misalignment of both of the rollers 31, 32. The in-plane bending deformation is a deformation wherein the transport belt 10 still resides within the x-z-plane, but the first lateral edge 11 of the transport belt 10 has developed a convex bending-out, and the second lateral edge 12 of the transport belt 10 has developed a concave bending-in. it should be understood that FIG. 3 shows only an instantaneous moment in the movement of the shown elements. Since the rollers 31, 32 in this example are misaligned, the transport belt 10 will deform and will at different times have a different three-dimensional shape.

Figure 6:
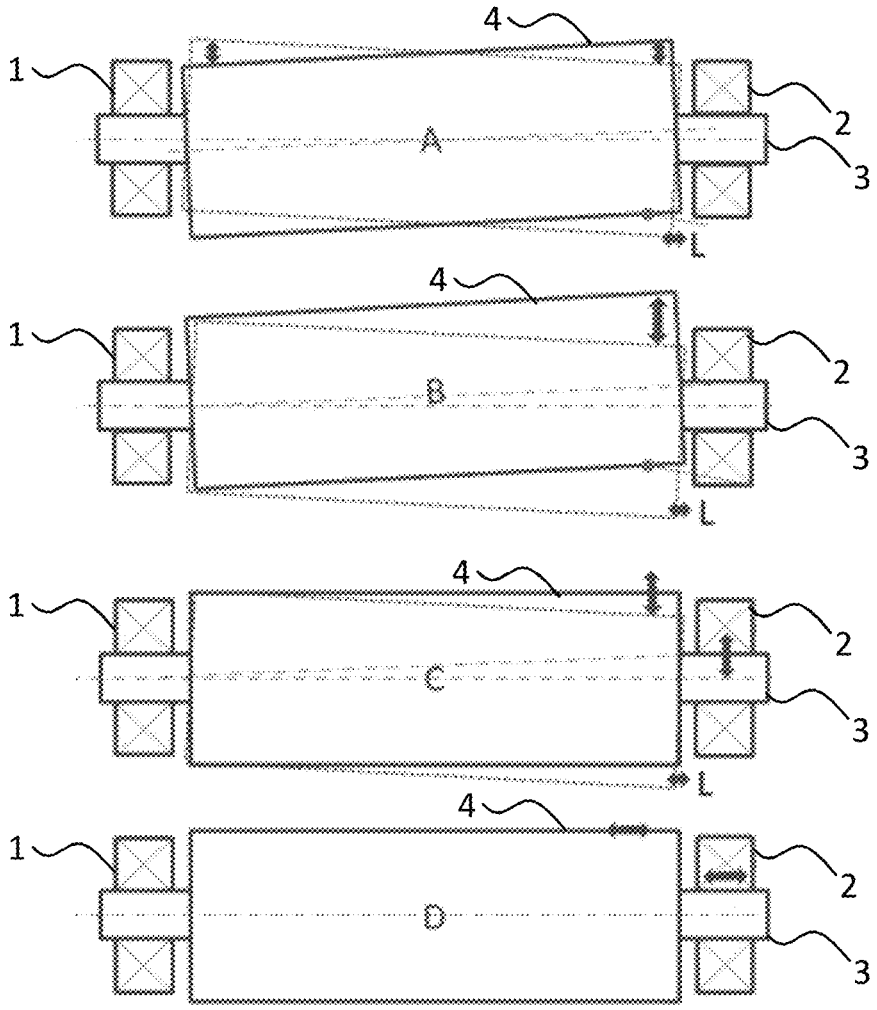
FIG. 6 schematically shows common deviations of rollers from their nominal position.

Based on the frequency with which each of the optical detectors 41, 42, 43 detects the markings 13 in/on the transport belt 10, the deformation calculating module 45 is able to determine the in-plane bending deformation. In FIG. 3 at least one additional optical detector of the detection system 40 may be placed also on the second lateral edge 12, for example opposite the middle optical detector 42. Evidently, the optical detectors 41, 42, 43 are capable to detect other deformations as well, for example a symmetric lateral (or: axial) runout of the belt in z-direction and/or any of the deformations caused by any of the misalignments or displacements as discussed with respect to FIG. 6.

Then, as has been described in the foregoing, the actuator control module 51 calculates control signals 91-94 for the actuator assembly 60 in order to partially or completely compensate the detected deformation of the transport belt 10 according to the deformation signal 81. The controlling may in particular comprise determining and effecting for each actuator 61, 62, 63, 64 a corresponding actuation intensity and/or actuation cycle given that many deformations of the transport belt will be cyclical in nature, or at least caused by cyclical displacements or rollers 31, 32, 33, 34 or parts of rollers 31, 32, 33, 34.

Apart from the actuators 61, 62, 63, 64 shown in FIG. 2 and FIG. 3, the actuator assembly 60 may comprise additional actuators for compensating additional deformations. For example, the actuator assembly 60 may comprise a steering roller for controlling an average lateral position of the transport belt 10, a skew correcting roller of non-uniform cylindrical diameter for compensating a skew of the transport belt 10 and/or the like.

In many embodiments, the controller 50 will be configured to compensate in any case as much of the detected deformation as possible by controlling the actuator assembly 60 accordingly.

Figure 4:
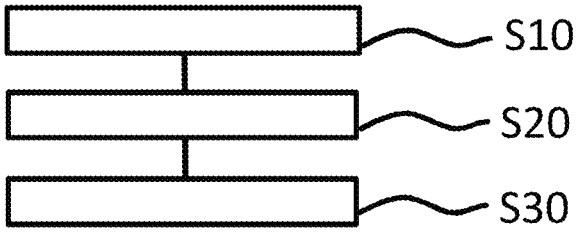
FIG. 4 shows a schematic flow diagram illustrating a method according to an embodiment of the present invention.

FIG. 4 shows a schematic flow diagram illustrating a method according to an embodiment of the present invention. The method will be described in the foregoing using also reference signs as used in FIG. 1 through FIG. 3 for the sake of improved intelligibility; however, the method is not restricted to (although certainly suitable for) use with the particular inkjet printer 100 as described in the foregoing. Thus, the inkjet printer 100, in particular its controller 50, may also be adapted based on any variants or options as described for this method and vice versa.

In a step S10, an endless transport belt 10 of an inkjet printer 100 is driven for transporting a medium 1 to be printed, using at least one roller 31, wherein in addition at least one additional roller 32, 33, 34 for driving and/or carrying the transport belt 10 is provided (or: present).

In a step S20, a deformation of the transport belt 10 including at least an in-plane bending deformation of at least a stretch of the transport belt 10 is detected, for example as has been described with respect to the detecting system 40.

In a step S30, at least one deformation signal 81 indicating the detected deformation is generated, in particular as has been discussed in the foregoing.

In a step S40, an actuator assembly 60 is controlled to change a position and/or orientation of at least one of the rollers 31, 32 of the inkjet printer 100 based on the at least one deformation signal 81, in particular for partially or (preferably) completely compensating the deformation indicated by the at least one deformation signal 81.

These steps S10-S40 may in particular be performed as has been described in the foregoing.

Figure 5:
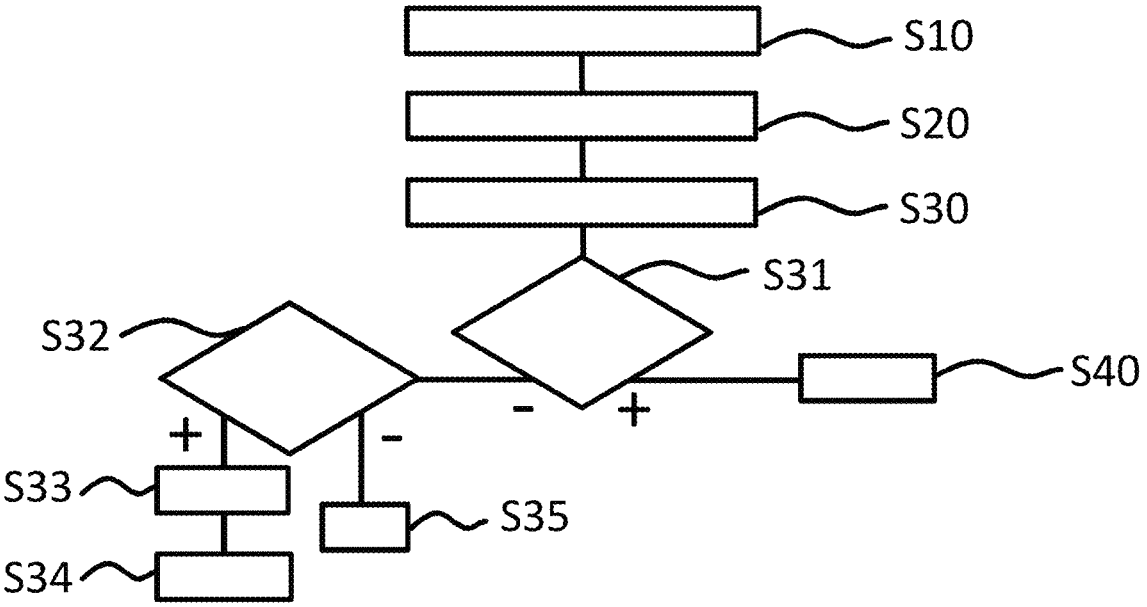
FIG. 5 shows a schematic flow diagram illustrating a method according to another embodiment of the present invention.

FIG. 5 shows a schematic flow diagram illustrating a method according to another embodiment of the present invention. The method will be described in the following using also reference signs as shown in FIG. 1 through FIG. 3 for the sake of improved intelligibility; however, the method is not restricted to (although certainly suitable for) use with the particular inkjet printer 100 as described in the foregoing. Thus, the inkjet printer 100, in particular its controller 50, may also be adapted based on any variants or options as described for this method and vice versa.

Steps S10 through S30 may be performed as has been described with respect to FIG. 4.

In a step S31, it is then determined whether or not the actuator assembly 60 (is configured and) can be controlled such as to sufficiently compensate for the detected deformation, wherein "sufficiently compensate" preferably means "completely compensate". If that is the case (indicated by a "+" sign in FIG. 5), then step S40 is performed in which the actuator assembly 60 is controlled to change a position and/or orientation of at least one of the rollers 31, 32 of the inkjet printer 100 based on the at least one deformation signal 81 such as to sufficiently (preferably completely) compensate the detected deformation.

If that is not the case (indicated by a "−" sign in FIG. 5), then, in a step S32, it is determined whether or not the actuator assembly 60 is able to compensate the detected deformation such as to leave a remaining deformation, wherein the remaining deformation is such that it can be sufficiently (preferably: completely) compensated by adjusting a print job. For example, a symmetric lateral run-out of the transport belt 10 may be compensated by adjusting a print job such that the print heads 21, 22, 23, 24 produce the image in a correspondingly (specifically: commensurately) laterally translated way on the medium 1.

If that is the case (indicated by a "+" sign in FIG. 5), then in a step S33 the actuator assembly 60 is controlled (e.g. by the controller 50) based on the at least one deformation signal 81 to compensate the detected deformation such that the determined remaining deformation remains, and in a step S34 the print job is adjusted such as to sufficiently (preferably: completely) compensate the remaining deformation.

If that is not the case (indicated by a "−" sign in FIG. 5), then in a step S35 a warning signal may be output. The warning signal may, for instance, cause the current print job to be aborted to prevent the inkjet printer 100 from taking damage due to an uncompensable misalignment of the belt and/or to prevent ink and medium 1 to be wasted on incorrectly performed print jobs.

While detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

It will be evident that the described embodiments may be varied in many ways. All such modifications as would be evident to one skilled in the art starting from what is explicitly described are intended to be included.

The invention claimed is:

1. An inkjet printer comprising:

an endless transport belt for transporting a medium to be printed;

a plurality of rollers including at least one roller for driving the transport belt and at least one additional roller for driving and/or suspending the transport belt;

a detection system configured to detect a deformation of the transport belt including at least an in-plane curvature of at least a stretch of the transport belt and to generate at least one deformation signal indicating the detected deformation;

an actuator assembly configured to change a position and/or orientation of at least one of the rollers of the inkjet printer; and a controller configured to control the actuator assembly based on the at least one deformation signal, wherein the transport belt comprises a plurality of markings, wherein the detection system is configured to detect the markings and to generate the deformation signal based on the detected and/or undetected markings, wherein the detection system comprises at least three optical detectors, wherein each optical detector is arranged and configured to detect the markings of the transport belt at a different location and to generate a corresponding optical detector signal, wherein the detection system is configured to generate the at least one deformation signal based on the at least three optical detector signals, wherein the transport belt is provided with a plurality of equally-spaced perforations along its longitudinal extent as the markings, wherein each of the optical detectors is configured to detect the position of perforations as a basis for the corresponding optical detector signal, and wherein at least two of the at least three optical detectors are arranged in a line parallel to a nominal lateral edge of the transport belt.

2. The inkjet printer of claim 1, wherein the detection system comprises an image-capturing camera configured to acquire an image of a lateral edge of the transport belt and a computing module configured to extract the curvature of the lateral edge within the acquired image and to generate the deformation signal based on the extracted curvature.

3. The inkjet printer of claim 1, wherein the actuator assembly comprises at least one axial actuator configured to change the axial positioning of a first end of a first roller of the rollers of the inkjet printer in an axial direction of the first roller.

4. The inkjet printer of claim 3, wherein the actuator assembly further comprises at least one longitudinal actuator configured to change the positioning of the first end of the first roller along a travel direction of the transport belt independent of changing the axial positioning in the axial direction of the first roller.

5. The inkjet printer of claim 4, wherein at least two of the rollers of the inkjet printer are each provided with a respective axial actuator and a respective longitudinal actuator.

6. The inkjet printer of claim 1, further comprising a controller configured to change at least one parameter of a print job to be printed based on the deformation signal.

7. The inkjet printer of claim 1, wherein the transport belt consists of at least one type of plastic.

8. The inkjet printer of claim 7, wherein the transport belt is formed of a plastic sheet provided with suction holes through which suction holes air may be drawn into a suction chamber adjacent and/or below the transport belt to hold a sheet onto the transport belt.

9. The inkjet printer of claim 1, wherein the actuator assembly is configured to change a position and/or orientation of the at least one roller for driving the transport belt and the at least one additional roller.

10. The inkjet printer of claim 9, wherein the at least one roller for driving the transport belt and the at least one additional roller are top rollers of the plurality of rollers.

11. The inkjet printer of claim 9, wherein the actuator assembly comprises an axial actuator and a longitudinal actuator for each of the at least one roller for driving the transport belt and the at least one additional roller.

12. An inkjet printer comprising:

an endless transport belt for transporting a medium to be printed, the transport belt being formed of a plastic sheet provided with suction holes through which suction holes air may be drawn into a suction chamber adjacent and/or below the transport belt to hold a sheet onto the transport belt;

at least one roller for driving the transport belt and at least one additional roller for driving and/or suspending the transport belt;

at least three sensors configured to detect a deformation of the transport belt including at least an in-plane bending deformation of at least a stretch of the transport belt and to generate at least one deformation signal indicating the detected deformation;

an actuator assembly configured to change a position and/or orientation of at least one of the rollers of the inkjet printer; and a controller configured to control the actuator assembly based on the at least one deformation signal, wherein the at least three sensors are arranged in a line parallel to a travel direction of the transport belt.

13. A method for controlling an inkjet printer, comprising the steps of:

driving, using at least one roller, an endless transport belt of the inkjet printer for transporting a medium to be printed, wherein in addition at least one additional roller for driving and/or carrying the transport belt is provided;

detecting a deformation of the transport belt including at least an in-plane curvature of at least a stretch of the transport belt;

generating at least one deformation signal indicating the detected deformation;

controlling an actuator assembly to change a position and/or orientation of at least one of the rollers of the inkjet printer based on the at least one deformation signal;

determining whether the actuator assembly can be controlled such as to sufficiently compensate for the detected deformation;

controlling, if that is the case, the actuator assembly to sufficiently compensate the detected deformation;

determining, when it is determined that the actuator assembly cannot be controlled such as to sufficiently compensate for the detected deformation, whether or not the actuator assembly is able to compensate the detected deformation such as to leave a remaining deformation, wherein the remaining deformation is such that it can be sufficiently compensated by adjusting a print job; and, when that is the case:

controlling the actuator assembly to compensate the detected deformation such that the determined remaining deformation remains; and adjusting the print job such as to sufficiently compensate the remaining deformation.

14. The method of claim 13, further comprising the step of:

outputting, when it is determined that the actuator assembly cannot be controlled such as to leave a remaining deformation that can be sufficiently compensated by adjusting a print job, a warning signal causing the current print job to be aborted.

* * * * *